US011065531B2

(12) United States Patent
Burrow et al.

(10) Patent No.: US 11,065,531 B2
(45) Date of Patent: Jul. 20, 2021

(54) MULTI-LAYERED GAME BOARD

(71) Applicants: James Paul Burrow, Fairbanks, AK (US); Traci Michelle Burrow, Fairbanks, AK (US)

(72) Inventors: James Paul Burrow, Fairbanks, AK (US); Traci Michelle Burrow, Fairbanks, AK (US)

( * ) Notice: Subject to any disclaimer, the term of this patent is extended or adjusted under 35 U.S.C. 154(b) by 0 days.

(21) Appl. No.: 14/258,266

(22) Filed: Jul. 1, 2014

(65) Prior Publication Data

US 2016/0001171 A1 Jan. 7, 2016

(51) Int. Cl.
*A63F 3/00* (2006.01)

(52) U.S. Cl.
CPC ..... *A63F 3/00088* (2013.01); *A63F 3/00261* (2013.01); *A63F 3/00895* (2013.01); *A63F 2003/00255* (2013.01); *A63F 2003/00299* (2013.01); *A63F 2003/00416* (2013.01); *A63F 2003/00936* (2013.01); *A63F 2003/00949* (2013.01)

(58) Field of Classification Search
CPC ..... A63F 3/00006; A63F 3/00214; A63F 3/00643; A63F 3/00088; A63F 3/00261; A63F 3/00895
See application file for complete search history.

(56) References Cited

U.S. PATENT DOCUMENTS

| | | | | |
|---|---|---|---|---|
| 8,079,594 | B1 * | 12/2011 | Greenawalt | A63F 3/00006 273/241 |
| 2011/0133404 | A1 * | 6/2011 | Kennedy | A63F 3/00006 273/243 |
| 2014/0135124 | A1 * | 5/2014 | Jaqua | A63F 3/00214 463/31 |

* cited by examiner

*Primary Examiner* — William H McCulloch, Jr.
*Assistant Examiner* — Ankit Doshi

(57) ABSTRACT

A portable board game that allows the player to journey through different terrains, providing a fun and educational foundation for learning all types of information with a unique game board; the multidimensional game board allows for choice within the gaming experience. The polarities of game components all have a secure, designated spot within the board game case. This platform provides an addition outlet for absorbing information while having fun at the same time.

1 Claim, 1 Drawing Sheet

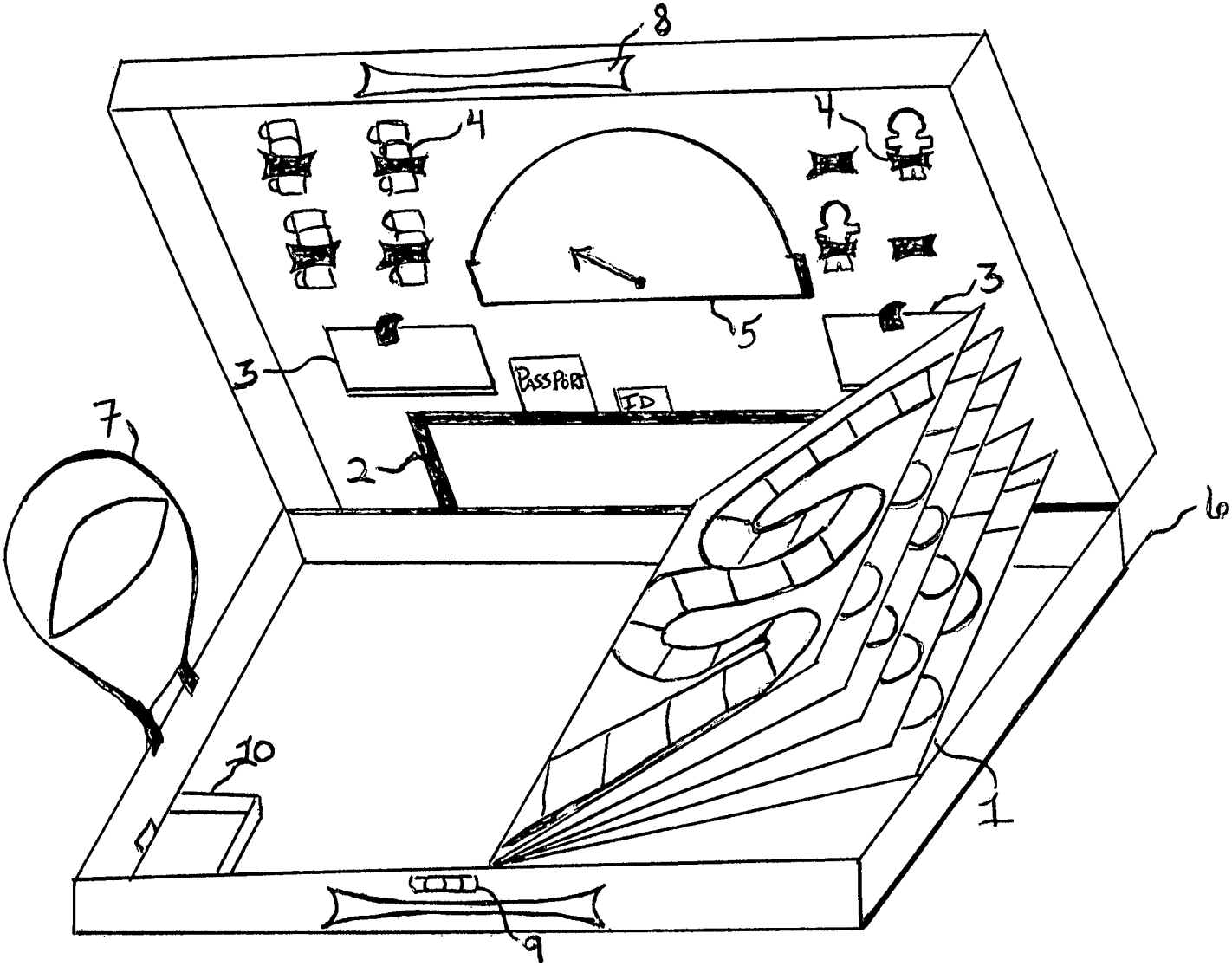
PASSPORT
ID
1
2
3
4
5
6
7
8
9
10

MULTI-LAYERED GAME BOARD

CROSS-REFERENCE TO RELATED APPLICATION

This is cross-referenced to the provisional patent, application No. 61/814,435, filing date, Apr. 22, 2013, Multi-Layered Game Board, Inventor James Paul Burrow, Fairbanks, Ak.

BACKGROUND OF THE INVENTION

1. Field of Invention

This invention relates to a game played on a board that is contained within a board game.

Playing games with friends and family is a fun and enjoyable way to spend time together. Just by virtue of playing them, board games can teach important social skills, such as communicating verbally, sharing, and waiting, taking turns, and enjoying interaction with others. Board games can foster the ability to focus, and lengthen the player's attention span by encouraging the completion of an exciting, enjoyable game. Board games help to improve memory, build confidence, and enhance educational skills. However, some games require less thought processing and low imagination or skills and provide little in the way of choices for the player. In addition, playing a board game provides the learning platform for all styles of learning, Visual, Auditory, and Kinetics. Covering, exposing and providing all three styles of learning allows for the ideal platform for teaching.

2. Description of Prior Art

While many board games exist, a flat, single surface board is limited in its choices of direction and information absorbed as in U.S. Pat. Nos. 5,743,740 and 5,123,846. The board game normally covers one subject and has only one graphic choice in which to view and interact. Some game board inventions have tested the limits of the flat surface, still providing a foundation for fun or educational content. The choices for the player are still limited in imagination and skill when focusing to open-ended play. From open-ended play comes more creating, and these units will encourage this in more ways than one.

Board game sets typically come with a cardboard box and a section for the board and for the game pieces. The often-cardboard box fits over the bottom of the box for storing, but it is not conducive for portability or other use outside of storing the pieces, as in U.S. Pat. No. 5,743,740. The game pieces are often loose leaving the owner to organize the components in objects not included in the game. In addition, the components are often packaged in plastic that is temporary and discarded. The cardboard, wood and a hinged aluminum hinged case already exist, as in U.S. Pat. Nos. 5,123,846, 4,545,768, and 3,773,154. In addition, some games, or puzzles come in this type of hinged case but the pieces are still often loose once removed from the plastic wrapping.

Play or craft Passports as well as identification cards are available. The Passport and identification making process is proprietary, and we will work with a company to provide those for adding to the game, we will be looking into working directly with DMV for an authentic identification card. If not, we will provide a process of an unauthentic identification card through mail or internet. Dog tag making machine exist and are readily available for the military as well as non-military and therefore is proprietary. We will be adding this feature to some games when appropriate and will work directly with a company for the machine and permission if necessary to utilize within the game. If not covered in a patent, and able to have proprietary constructs within this patent, this patent covers the utilization of above mentioned, passport, identification card and/or "dog tags" within a portable gaming unit.

Die cast metal cars exist as do layered (A top, middle and bottom layered pieces that can be removed and placed back together) die cast cars, planes, trains, etc. The pieces come apart, but only interlock with the original car pieces and may NOT interchange with another car. Rubber three layered cars exist, each of those pieces stack on the original car that is, the pieces may NOT interchange with another car. As in U.S. Pat. Nos. 4,540,377, and 1,890,624. There are products that come apart, but not that interchange with other cars that we are aware of currently.

USB online connection ports exist.

This technology will combine a tangible object with the online gaming experience. This also allows the opportunity for the player to pick more players to play from across the world while providing a child friendly online environment. Since this invention is proprietary, we would acquire the necessary permissions to utilize this technology. As far as we know a USB port to a board game has not been done. If not then this patent covers the addition of the USB component to the portable, multi-dimensional board gaming unit.

SUMMARY OF THE INVENTION

In view of the foregoing, the described game board will allow more choices for the player and the educational content placed on the board will provide an open-ended field for imagination and will increase their skills and education content in many areas. The unique game board, 1, allows for a variety of experiences throughout the game. With the layers on this board 1, one can begin on the first layer or level and play one layer or play two, three, or all the layers in one sitting. One can also choose to begin on the middle layer and finish on the last layer, 1. Alternatively, the player can begin on the last layer and play only one layer or level, 1. A younger child or a child with a shorter attention span could play only one layer in one sitting, and the player/s could chose which layer or level they wanted to play in that sitting. The multi-layers 1 allow for providing several different terrains, experiences, and information within each unit 6. This also allows for a multitude of information and graphics shared upon each board game unit. The typical flat board has a certain number of spaces, with this multi-dimensional board there is double and triple the amount of playable surface area offered within one board game.

In this board game, all the game pieces have a place within the hinged case, as shown in labels 1, 2, 3, 4, 5, 6, and 7, some units released with a cardboard-based case, and some made from aluminum, and some from wood. Each game piece is secure until removed, as shown in labels, 1, 2, 3, 4, 5, 6, and 7, no need for extra wasted plastic wrap that is then discarded. Each component within the hinged case is also removable to play on a flat surface without the use of the case thus providing an empty hinged case for individual open playtime. (The case 1 empty, is not shown) The case owner is provided with a choice of a blank slate, and can remove the components within the hinged case or some of the items can remain and the rest filled with a plethora of items. The owner/player could utilize the hinged case 6 in any number of ways for example, a spy case, a travel case, a doctor case or any other creative play moment; it could hold anything that will fit, in which the owner desires within place of the game components.

The front of the cardholder will match the front of the cards for ease of sorting and storing, the front of each card will have an action or a statement corresponding with the games content. And can be defined A units long and B units wide, to define A times B with Y number of cards. A passport, appropriate stamps and the option to have an ID made for some units. The option to create a dog tags, will also be a part of some units; cards, passport, ID and dog tags made from a material suitable, paper, cardboard or otherwise can be defined as X units long and Y units wide for said unit while staying in the scope of the invention.

The owner, more appropriately the parents can decide if they want their child/ren's real information (address, age, birth date etc.) on the identification card 2 or they could choose made up information for the identification card. Dog tags will be added with real or made up information for certain board game units 6. Any other personalized component that is appropriate to the theme of the game unit could be added to further enhance the gaming experience and is not limited to the above stated. For example, a folded map of the terrain could be provided, certificates, and other papers that could fit in the case and are appropriate to the embodiment of the scope of the invention and the theme of the board game.

Die cast metal cars, as shown in label 4, for the racing through terrains game, to have three layers of die cast metal cars that have a top, middle and bottom layer. Each layer of the car will be unique in its features. The difference from prior art would be that, each top (The body style of the car or truck) fits into each middle (the driver area, the seats, art details of the contents in the car or truck) and bottom (The main frame of the car, providing different tire types for different terrains). Each piece will interchange with each of the other vehicles parts (Top, middle, bottom) provided in the set. A unit containing eight cars will have the possibility of 24 interchangeable pieces. Alternatively, offering 192 possible combinations, thus providing many choices for the players.

The pieces, as shown in label 4, alternatively could instead be an animal, person, plane, or boat or any other shaped pieces to correspond with the theme of each board game unit as described in the claims. The spinner utilized to move said pieces will have characters in the form of numbers and/or letters and or symbols, the spinner is reversible, the arrow of the spinner can be removed and the platform of the spinner can be turned around and the arrow of the spinner replaced on the now front side of the spinner. The spinner is removable to lay flat on a table surface and can easily be put back in place, the spinner can be defined as X units long and Y units wide, to define X times Y in radius while staying the scope of the invention.

The portal, 7, is a jumping point for the player. When a player has completed a layer and is waiting for the other players if applied, the player jumps through the portal 7 to the rest stop (not shown). The rest stop can be comprised of any number of materials, cardboard, plastic, or metal and will be a folding component. The rest stop would be unfolded and lay flat for storing and then the owner can convert or build the component to a 3D interactive component, when play is complete, it can be unfolded and lay flat at the bottom of the board game case, 1. The design of each rest stop will correlate to the theme of each board game. Example for the car game the rest stop is a mechanic shop, airplanes, a hanger, for some games the rest stop will be shaped like a tent. For some games, it may be in the shape of the animal's habitat.

Each one will stay in the scope of this invention times Y amount of themes. Each component will be interactive with built in details that correspond with the theme of the board game unit and will fold down flat for storage and pop up to secure with tabs during play, then fold down flat again for storing.

The USB port connection, as shown in label 10, would allow access to a safe internet server free of adult content. This connection will allow children a safe server to find other people to play the game over the internet, thus providing a tangible object with an online component. The board game 6 can be played without being online, the online USB port connection 10 will allow the choice of more players, more educational content to explore on a child safe server, as well as more ways to play with upgrades along the way.

DETAILED DESCRIPTION OF THE PREFERRED EMBODIMENT

The accompanying drawings illustrate complete preferred embodiment in the present invention according to the best modes presently devised for the practical application of the subject educational game:

The multidimensional game board 1, is made out of cardboard, recycled cardboard, plastic, wood or metal. The game board is nestled in the portable case in a designated area, 6. Upon opening the case, the game board 1, is positioned to the right of the bottom level of the case 6, each dimension on top of one another, this is a closed position (The game board is pictured partially open to show the dimensions). The content on the top dimension can be played upon as it sits. When the first dimension has been played and all players have jumped through the portal, 7, to the rest stop, 11, the first dimension of label 1 is flipped up to the left to reveal the second dimension of play surface. The current dimension lays flat for play. This continues to the 3th, 4th and 5th, etc. dimension of the game board. Each dimension turns to the left, when playing on the last dimension, all dimension of the board will be nestled to the left within the case, 6 or on a table surface. The board 1 can be removed from the case 6 to play upon a table surface in the same manner as described above. The player/s can chose to begin on the first dimension or any of the middle dimension or the last. The player/s can chose to play one layer or all of them in one sitting depending on the attention span and or age of the child.

This game can be played alone, exploring the content, or it can have up to eight players. The game pieces, 4, will correlate to the theme within the board game. The game pieces can be made from non-recycled or recycled cardboard, plastic, or metal/aluminum or any other material while staying in the scope of the embodied invention. The car game for example, where a player races through the different terrains will have the die cast interchangeable top. middle, and bottom pieces as described above. The interchangeable cars will be provided in any unit where appropriate. A game teaching about animals and their habitats would have animals with full detail and made from plastic, wood, or any other material appropriate for the game pieces 3. Games teaching about dogs could have game pieces, 4, of the different breeds of dogs in full detail. Games teaching Geography will be provided with different types of transportation to travel the world. Since each game will be unique and there are endless choices for educational content, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope and embodiment of the invention, times Y number of unit themes and X number of detailed art.

The case itself is only illustrated in the drawing 6. The size and dimensions will be modified towards availability of manufacturers, materials, and ease of use for the player as well as optimum size for placement on a store shelf. Some cases/units 6 will be made ideally from recycled cardboard, plastic or aluminum, alternatively the units could be made from non-recycled materials and any material appropriate within the scope of the invention. Large versions as well as smaller travel versions are covered under the invention as has been described in detail with particular reference to certain preferred embodiment's thereof, but it will be understood that variations and modifications to the size, shape, and graphics for content can be effected within the spirit and scope of the invention. The case itself 6 is hinged (Not shown in picture) when closed the top and bottom part of the case fit together and secure closed with a lock 9. Each version of the case 6 may have a flip lock (not shown in picture) or a scrolling number lock enclosure or other type of lock 9. Alternatively, any type of lock would be covered under the embodiment and scope of the invention. When open, the case lays flat on a flat surface. Each component within the case 6 is removable; the pieces can be placed on a table surface to play. Alternatively, the case itself, 6 once empty could be used as an open-ended play case.

Some themes of the multidimensional game board set within a board game include but are not limited to the following while keeping within the scope and frill embodiment of the invention.

Examples of some of the terrains: around and through volcanoes, oceans, over rocks and ice, through dense fog and the sky experiencing lightening, inside a cavern, on sand for The Earth and other planets experience.

Examples of some of the educational themes: Combination units such as A Pre-K unit, Kindergarten unit, a first-grade unit, a second grade unit, a third grade unit through all ages and grades covering state standards of Language, Math, History, Science, Art and Music, and Technology which would provide a foundation of educational learning for each grade level. Playing a board game provides the learning platform for all styles of learning, Visual, Auditory, and Kinetics. Separate units will cover information such as, Language, Math, History, Science, Music and Art while traveling over terrain or going on a time travel adventure. Action cards, or specialty cards, when appropriate will provide movement, "Stand up and shout C A T!" Those sorts of interactions solidify the information for the learner. Care has been taken to ensure an optimum standard to ensure placement of the information from short-term to long-term memory.

The invention unit would cover a timeline of inventions, breaking down to closer detail some of the most popular inventors and their inventions while showing a timeline of inventions until future-present. A unit on weather cycles would education children while having fun. A unit on the wars of History as well as the leaders would provide an educational foundation while having fun. In addition, units about how things are made would provide wonderful graphics explaining the layers of Earth and the process of gathering and utilizing wood, metal, coal and the like and the process of providing said items to the public adding the importance of taking care of our Earth and its resources. Units on Geography would allow the player/s a hands on environment for learning the Continents in various ways from the history of the change of Earth to how goods were exchanged, to the current ways of global exchange and the importance of 'fair-trade. A unit on the history of how cars, airplanes, boats, and other transportation vehicles were made, or the progress of computers and technology would provide a great explanation of facts while having fun traveling through time.

Units on animal habitats as well as a unit on the community (Firefighters, Doctors, Farmers, etc.) provide interactive, open-play opportunities for children to explore their world up close and personal with another choice beyond toys, books and the internet. All of these units provide a foundation for cooperative play and exploration of information while learning social skills. The details of the game pieces 6, the animals for example will be true to real life and allow the exploration of details of the animals, their eating and living habits, and their habitats. The "rest stop" provides an interactive component that correlates to the theme of the unit and scope and embodiment of the invention.

Alternatively, there are any number of game units that could be made utilizing this invention. Games that teach about, fish and fishing, how paper is made, the rain and water cycles, glass and how it is made, metal and how it is made. Alternatively, we could work with other companies to collaborate if the company was so inclined.

Each of the game components and the graphics will be appropriate for the theme of each unit. The spaces and cards will correspond appropriately to the theme within the unit while staying in the scope and embodiment of the invention.

While the invention has been particularly shown, described and illustrated in detail with reference to the preferred embodiment's and modifications thereof, it should be understood by those skilled in the art that equivalent changes in form and detail may be made therein without departing from the true spirit and scope of the invention as claimed except as precluded by the prior art.

Rules for Moving Through the Game

To begin, open the case and lay the unit on a flat surface, remove the portal, 7 and the rest stop, (not shown) slide the portal along the side edge of the lower part of the case to attach it in an upright position to be able to "jump through" to the rest stop. The rest stop, which is stored flat, needs to be built by slipping a few simple tabs into place to make a 3D model. The player/s then chose a game piece, 4 from the case 6, and places the piece/s 4 on the first space of the dimension, 1, they decide to play on first. One could chose the first dimension, or the second or the third and so on, including beginning with the last dimension and play their way to the first, or jump from the first to the last and back to the first in any unlimited combination. The player/s also draws one of any number of specialty cards, 3 to use through the game when/if needed. Once the specialty card, 3 is utilized, the player discards that specialty card back in the pile of specialty cards, 3 and draws another card, 3 to utilize any time in the game.

The youngest player goes first, or the players can spin the spinner, 5, for a highest number, or a lowest number and spins. The player then moves their chosen piece that many spaces on the current dimension in play and does what the space indicates. If the space is blank on the board 1, their turn is over. Some spaces on the board 3 will have a "draw a card" the player would then draw a card, 3 and do what the card indicates.

Some of the spaces 1 and cards 3 will have opportunities for physical movement actions, example, "Drive around the room and honk your horn three times." Most cards will have reasons for a "lose a turn" or "go forward three spaces." Some cards will state they can be saved and used later in the game. The next player, if any, then takes their turn to spin and move.

The first player to reach the end of the first layer 1 played goes through the "portal" 7 to wait for the other players. The rest stop will provide the player a moment of a rest from the game this is extremely helpful for young children and children with shorter attention spans. They can interact and play with the rest stop or they can take a moment to get a drink or move to stretch or simply watch the rest of the players until they have reached the end. Once all the players are off the current dimension, 1 if desired, they flip to the next dimension they want to play and continue to play from the first space on the layer 1 they want to play next. For the end of the game, the last space on the last dimension played, the player jumps through the portal 7 to the rest stop.

Some of the spaces on the multidimensional board 1 will have statements of, "Go forward 2 spaces" and some spaces will interact with the content of each board, "Stopped to view a colony of penguins in Antarctica, lose a turn, but enjoy the view." Some spaces 1 will have "draw a card" when the player lands on one of those spaces they draw a card 3 and do or receive what the card states. Some of the cards, 3 are utilized later; the other cards, 3 would be discarded after using directly after being drawn. Some examples of the cards but not limited to, "You paid attention around a tight turn, if you have new tires (a specialty card saved for later) go forward 4 spaces." Alternatively, "Distracted by a rock slide, missed the turn, go back 2 spaces."

Some cards 3 will have education facts. Some units 6 will have cards 3 with questions about the facts, if answered correctly the player moves forward. Some cards will have questions for the player, "Where on Earth would you like to visit?" would be an appropriate card for a Geography game unit. "If you could travel to a planet, which planet would you like to visit?" would be an appropriate card for a game unit teaching about the planets.

Instead of making an educational unit 6 all facts and no fun their will be a variety of fun and facts in each unit 6. Some units 6 will be heavier in educational content and alternatively, some units 6 will be all about racing on specific terrain on the game board 1. These units 6 will still teach, but in a non-obvious and non-aggressive way. Example but not limited to, if on the dessert terrain the cards 3 and actions will pertain to that terrain on the game board 1.

"Going over rocky terrain, if you have the rock climbing tires (a specialty card, 3) go forward two spaces, if not, go back one space." If in a frozen terrain, the cards and actions will pertain to that terrain "It is −60 below 0 degrees, the belt as cracked, if you have an extra, used it now, if not, lose a turn."

Some of the games have a collaborative play aspect. Some games will have a designated winner and will be explained in the instructions pertaining to that game unit 6. The first player to "complete the adventure" or the player "that survived" the war is the "winner" of the game. Alternatively, some units will have trophies/certificates that the "winner" earns and gets the title to until the next game.

I, James Paul Burrow as the main inventor and Traci Michelle Burrow as a secondary inventor have invented a new design for a game board within a board game, as set forth in the following specification. The multi-dimensional game board and all the game pieces have a designated place within the board game.

FIG. 1 is a front elevated view of the portable, hinged board game opening. The case itself lays flat once opened completely. When closed the entire game and the game components are secure within the case.

Components within FIG. 1

1 is a front elevated view of the Multidimensional game board partially open. To begin the game board dimensions lay flat on top of one another (not fanned out like in the picture, this is to illustrate how the dimensions of the board move to open to the next dimension/level) on the right side of the case. Each dimension is then flipped to the left to play the next dimension. Each dimension lies flat to play upon the surface, then the next dimension flips to open to the next dimension to then lay flat. While on the last dimension the game board will be to the left side of the case or surface. The game board remains secure until removed from its attachment.

2 is a front elevated view of the placement spots for the Passport, Identification card and/or dog tags and has space to add papers or maps when appropriate to the theme of the board game unit.

3 is a front elevated view of cardholders. The cards fit securely within the flaps and snap closed. The original art placed on the front of the cardholder will match the back of the cards for ease of replacing back in place when the game is being stored. The front of the card will have the instructions for the player. There are "draw a card" cards in one pocket and there are specialty cards in the other pocket.

4 is a front elevated view of the car or game piece placements. Each car or game piece remains secure within the band until removed.

5 is the spinner for the board game. This piece remains secured until removed from its attachment.

An alternative picture will be on the back of the spinner and the player can chose either side during play.

7 is a front elevated view of the portal that the player "jumps through" to move on to the next dimension. The portal lays flat in the bottom of the case when not in play. It is erected on the side of the case when in play.

8 is a front elevated view of the handle/s.

9 is a front elevated view of the closer for the case. The basic and mid-range case will have a flip closer lock. The deluxe case will have a number lock closer. The number lock is pictured.

10 is a front elevated view of a USB connection component that will allow connection to other players around the world. This connection will also allow access to a safe internet site that connects the player/s to further educational information on a safe server, void of ads and adult content.

We claim the design for the board game and the design for the game board within the case as shown. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the embodied invention.

The invention claimed is:

1. A board game with multiple playing surfaces set within a portable gaming unit(s), comprising:

a portal;

a rest stop;

a spinner or a dice;

one or more cardholders;

one or more sets of cards;

a set of rules; and a set of movable pawn pieces comprised of a set of die-cast metal vehicles;

the portable gaming unit(s) holds all components, the portable gaming unit is A units long and B units wide to define A times B unit size to hold;

a game board(s) with multiple playing surfaces are connected at one edge, each of the multiple playing surfaces lays flat to play, and is lifted to turn and play another one of the multiple playing surfaces, each of the game board(s) with the multiple playing surfaces is X wide and Y long providing at least four different surfaces of the game board(s) with the multiple playing surfaces to play upon and components;

the set of die-cast metal vehicles are interchangeable with every other set of die-cast metal vehicles produced for each of the portable gaming unit(s), the die-cast metal vehicles are comprised of three layers; a top layer, a middle layer, and a bottom layer, each of the layers of the die-cast metal vehicles are interchangeable with each other set of the die-cast metal vehicles produced for every other of the portable gaming unit(s); for the movable pawn pieces comprised of die-cast metal vehicles, each of the portable gaming unit(s) will provide up to W number of the movable pawn pieces comprised of the die-cast metal vehicles with color choices, each of the movable pawn pieces comprised of the die-cast metal vehicles can be defined as O times P in size with Q number of art details upon the movable pawn pieces comprised of the die-cast metal vehicles and;

the game board(s) with the multiple playing surfaces, allows many choices, before the game board with the multiple playing surfaces is played upon, choose which one of the multiple playing surfaces to begin and which one of the multiple playing surfaces to play second, third and so on, and which of the multiple playing surfaces to end play, the rules for playing the game board with the multiple playing surfaces allows collaboration through each game played, order of play can be different each time;

the portal is a location on the game board(s) that allow the player to jump through to the rest stop before leaping to the next multiple playing surfaces; and the rest stop allows the player to pause the game to interact or to take a break;

and the portable gaming unit(s) comes equipped with an USB port to connect online.

* * * * *